US010721992B2

(12) United States Patent
Bernhard et al.

(10) Patent No.: US 10,721,992 B2
(45) Date of Patent: Jul. 28, 2020

(54) SOLE STRUCTURE FOR A FLEXIBLE SHOE

(71) Applicant: ON CLOUDS GMBH, Heiden (CH)

(72) Inventors: Olivier Bernhard, Heiden (CH); Ilmarin Heitz, Zürich (CH)

(73) Assignee: ON CLOUDS GMBH, Heiden (CH)

( * ) Notice: Subject to any disclaimer, the term of this patent is extended or adjusted under 35 U.S.C. 154(b) by 0 days.

(21) Appl. No.: 15/575,722

(22) PCT Filed: May 18, 2016

(86) PCT No.: PCT/EP2016/061149
§ 371 (c)(1),
(2) Date: Nov. 20, 2017

(87) PCT Pub. No.: WO2016/184920
PCT Pub. Date: Nov. 24, 2016

(65) Prior Publication Data

US 2018/0295934 A1 Oct. 18, 2018

(30) Foreign Application Priority Data

May 20, 2015 (CH) ..... 702/15

(51) Int. Cl.
*A43B 13/14* (2006.01)
*A43B 13/18* (2006.01)
*A43B 13/20* (2006.01)

(52) U.S. Cl.
CPC ..... *A43B 13/141* (2013.01); *A43B 13/181* (2013.01); *A43B 13/206* (2013.01)

(58) Field of Classification Search
CPC ..... A43B 13/141; A43B 13/181; A43B 13/14
(Continued)

(56) References Cited

U.S. PATENT DOCUMENTS 9,717,304 B2 * 8/2017 Bernhard ..... A43B 13/125
2008/0289224 A1 11/2008 Sink
(Continued)

FOREIGN PATENT DOCUMENTS

DE 20 2012 010 879 U1 11/2012
DE 20 2014 003 016 U1 4/2014
(Continued)

OTHER PUBLICATIONS

English translation of DE202014003016, to On Clouds, obtained via espacnet.com on Jun. 18, 2019.*
(Continued)

*Primary Examiner* — Clinton T Ostrup
*Assistant Examiner* — Patrick J. Lynch
(74) *Attorney, Agent, or Firm* — Pauley Erickson & Kottis

(57) ABSTRACT

In a sole structure for a flexible shoe with a flexibly elastic mid-sole which comes at least partially into contact with the ground during walking and has laterally open, channel-containing elements which are oriented transversely with respect to its longitudinal direction and extend down towards the ground, wherein the mid-sole has a border strip bridging each of the channel-containing elements, wherein the outwardly directed end faces of the channel-containing elements are provided with horizontal predetermined fold notches, and wherein the channel-containing elements are deformable vertically and/or in the longitudinal direction in the area of the border strip under the effect of forces that act vertically and/or in the longitudinal direction during walking, until their lateral openings become worn, wherein the predetermined fold notches have a vertical width corresponding to the height of the lateral openings of the channel-containing elements and are flush with the lateral openings of the channel-containing elements.

7 Claims, 2 Drawing Sheets

(58) Field of Classification Search
USPC ..... 36/28
See application file for complete search history.

(56) References Cited

U.S. PATENT DOCUMENTS

| | | | | |
|---|---|---|---|---|
| 2011/0016749 | A1 | 1/2011 | Callahan et al. | |
| 2011/0162232 | A1* | 7/2011 | Gazzara | A43B 1/0072 36/29 |
| 2012/0042541 | A1* | 2/2012 | Miner | A43B 13/122 36/88 |
| 2014/0059883 | A1* | 3/2014 | Adeagbo | A43B 13/187 36/28 |
| 2015/0230549 | A1* | 8/2015 | Bernhard | A43B 13/181 36/25 R |

FOREIGN PATENT DOCUMENTS

| | | | | |
|---|---|---|---|---|
| FR | 2 088 626 | A5 | 1/1972 | |
| WO | WO 03/103430 | A1 | 12/2003 | |
| WO | WO 2015/055863 | A1 | 4/2015 | |
| WO | WO-2015055863 | A1 * | 4/2015 | A43B 7/06 |

OTHER PUBLICATIONS

European Patent Office, International Search Report, Form PCT/ISA/210, for International Application No. PCT/EP2016/061149, dated Aug. 23, 2016, (3 pages).

* cited by examiner

SOLE STRUCTURE FOR A FLEXIBLE SHOE

BACKGROUND OF THE INVENTION

Field of the Invention

The present invention relates to a sole structure for a flexible shoe with a soft elastic midsole, which at least partially comes into contact with the ground during walking and which has channel-shaped elements that are open at the side, are oriented transversely in relation to the longitudinal direction of the midsole, and protrude downward toward the ground. The midsole also has an edge strip, which bridges the respective channel-shaped elements, narrows the cross-section of the channels in the channel-shaped elements, and determines the height of the lateral openings of the channel-shaped elements. The outward-facing ends of the channel-shaped elements are provided with horizontal predetermined fold notches. In response to forces acting in the vertical and/or longitudinal direction during walking, the channel-shaped elements can be deformed in the vertical and/or longitudinal direction until their lateral openings in the region of the edge strip close.

Discussion of Related Art

A sole structure of this kind is known from DE 20 2014 003 016 U1. In the known sole structure, when the lateral openings of the channel-shaped elements close in response to the forces exerted when walking, a contact of the channel bottoms with the underside of the edge strip occurs. This essentially stops the deformation of the channel-shaped elements and produces a solid standing surface for the push-off in the next step. Friction also hinders the ability to slide horizontally, i.e. the ability of the surfaces touching each other to slide against each other in the longitudinal direction, which counteracts the above-mentioned floating effect.

In order to achieve this desired effect, it is advantageous if the channel-shaped elements lie down by shearing and in so doing, the flat channel bottoms come to rest flat against the underside of the edge strip. This deformation behavior should be encouraged by the predetermined fold notches, which in the known sole structure, are produced by a plurality of horizontal flutes situated one above the other, which are uniformly distributed both at the level of the lateral openings of the channel-shaped elements and in the region of the edge strip.

SUMMARY OF THE INVENTION

The object of the invention is to achieve further functional improvement of a sole structure of the type mentioned at the beginning.

This object is attained according to the invention by a sole structure as described. The sole structure according to the invention is characterized in that the predetermined fold notches have a vertical breadth, which corresponds to the height of the lateral openings of the channel-shaped elements, and are respectively aligned with the lateral openings of the channel-shaped elements.

Because they are embodied with a large breadth and are arranged in alignment with the lateral openings of the channel-shaped elements, the predetermined fold notches according to the invention have an action that is significantly more pronounced and locally concentrated and the deformation is thus more prominent than is possible with the plurality of flutes across a larger area in the known sole structure.

The flutes of the known sole structure do in fact also facilitate the deformation of the channel-shaped elements, but by contrast, they promote a deformation that is uniformly distributed over their height, similar to the bellows of an accordion. When subjected to a more oblique stress, primarily only a flank of the channel-shaped elements is compressed, which results in a deformation of their flat bottoms, forming a bulge. With the embodiment according to the invention, even with an only slightly oblique stress, the channel-shaped elements tend to shear while largely retaining their flat bottom shape, without forming a bulge.

The predetermined fold notches can have a depth that corresponds to 2.0-8.0 mm, preferably one third of their vertical breadth.

The midsole can be efficiently produced in one piece by means of injection molding.

BRIEF DESCRIPTION OF SEVERAL VIEWS OF THE DRAWINGS

An exemplary embodiment of the invention will be described below with reference to the drawings. In the drawings.

DETAILED DESCRIPTION OF THE INVENTION

Figure 1:
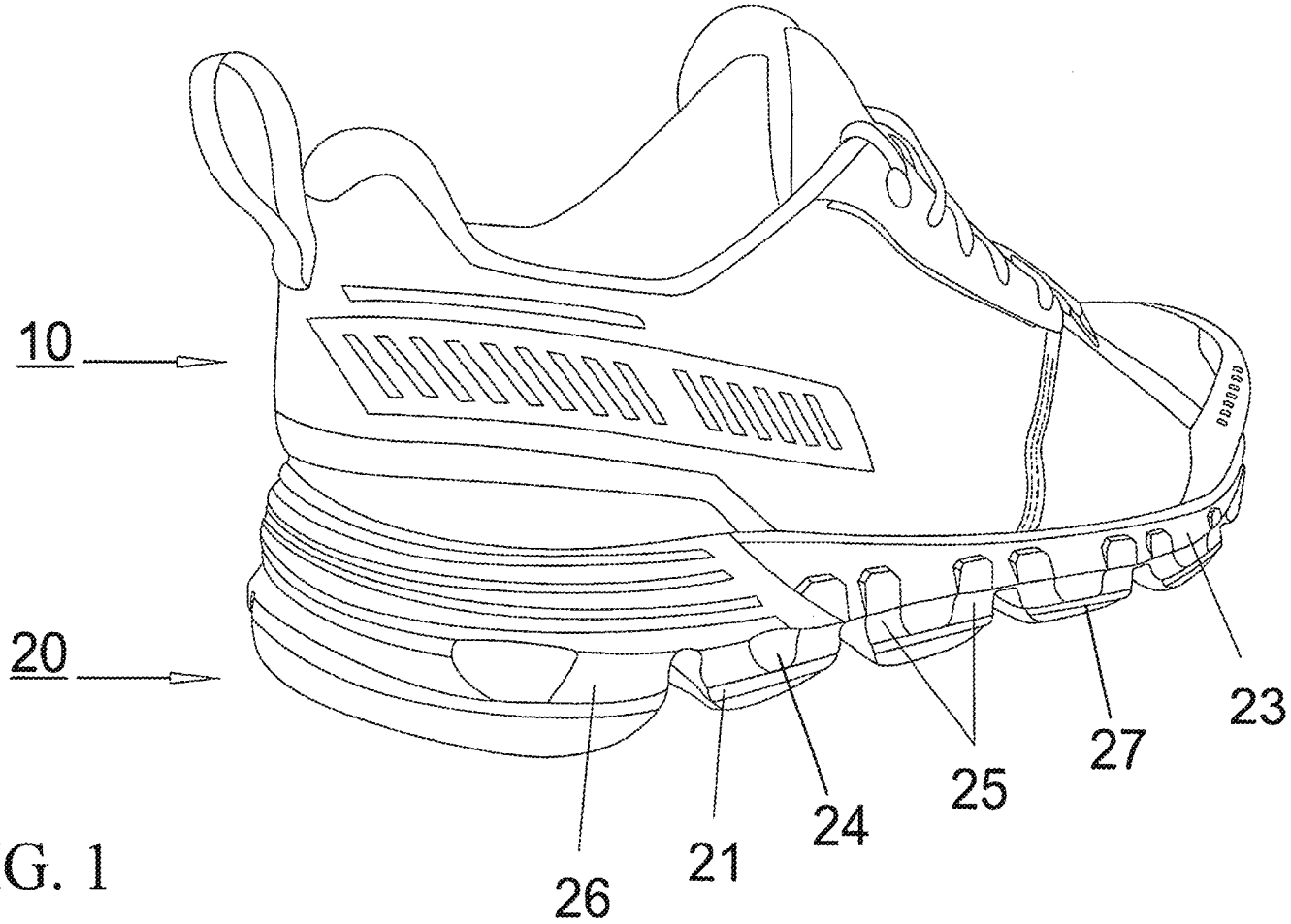
FIG. 1 shows a right shoe with a sole structure according to the invention, in a perspective side view seen obliquely from the rear.

In the shoe shown in FIG. 1, the reference numeral 10 identifies the upper that encloses the foot and the reference numeral 20 identifies a soft elastic midsole of a sole structure according to the invention. By largely eliminating an outsole, part of the midsole 20 is directly in contact with the ground. Only the midsole 20 of the sole structure is visible in FIG. 1.

In the longitudinal direction of the shoe, the mid-sole 20 has a plurality of channel-shaped, or channel-containing elements extending transversely to the longitudinal direction, which are approximately the same width as one another and are distributed in an approximately uniform fashion. In FIG. 1, only one of these elements is labeled with the reference numeral 21.

An edge strip 23 provides an outer reinforcement of the channel-shaped elements 21. The edge strip 23 frames an incompressible, but elastically flexible plate not visible in FIG. 1, which is embedded between the upper 10 and midsole 20, approximately at the level of the upper edge of the edge strip 23, flush with this upper edge, and is connected to these parts. The plate only has a thickness of about 2 mm so that the headroom of the channels in the channel-shaped elements 21 inside the border formed by the edge strip 23 is about twice the height of the lateral openings 24 underneath the edge strip 23 itself. In other words, the edge strip 23 bridges the channel-shaped elements 21 on the outside while narrowing their cross-section, including a vertical cross-section.

The plate framed by the edge strip 23 stiffens the midsole 20, with the plate essentially determining the integral, elastic flexibility of the sole structure. The rather local elastic flexibility is determined by the channel-shaped elements 21 of the midsole 20.

At their outward-facing ends, the channel-shaped elements 21 are provided at their front and rear flank with a horizontal predetermined fold notch 25. The predetermined fold notches 25 have a vertical breadth, which approximately corresponds to the height of the lateral openings 24, and are aligned not only with one another, but also with the lateral openings 24 and are respectively at the same height as them.

In the rearmost of the elements 21, an indentation 26 that corresponds to the predetermined fold notches 25 is provided, which extends partway around the heel part.

The predetermined fold notches 25 have a depth that corresponds to 2.0-8.0 mm, but is preferably one third of their vertical breadth. In FIG. 1, the predetermined fold notches are depicted as rounded, but they could also be embodied as V-shaped.

Generally speaking, the thickness of the channel-shaped elements decreases from the heel region to the ball region. While retaining the same external width, the wall thickness of the channel-shaped elements 21 also decreases in the longitudinal direction of the shoe from the heel region to the ball region. In the heel region, the channel-shaped elements 21 are also somewhat thicker at the front than they are at the rear, in the mid-foot region, they are about the same thickness at the front and rear, and in the ball region, they are somewhat thinner at the front than at the rear.

The bottoms 27 of the channel-shaped elements 21 are each embodied as flat, both at their top inside the channels and on their underside. Together with the edge strip 23 and somewhat inclined flanks of the channels, this produces approximately trapezoidal cross-sections for the lateral openings 24.

The reciprocal spacing of the channel-shaped elements 21 in the longitudinal direction of the shoe is selected to be large enough that they can be individually deformed by shear forces in this direction until their lateral openings 24 close by lying flat. The predetermined fold notches 25 significantly facilitate and encourage this type of deformation.

Figure 2:
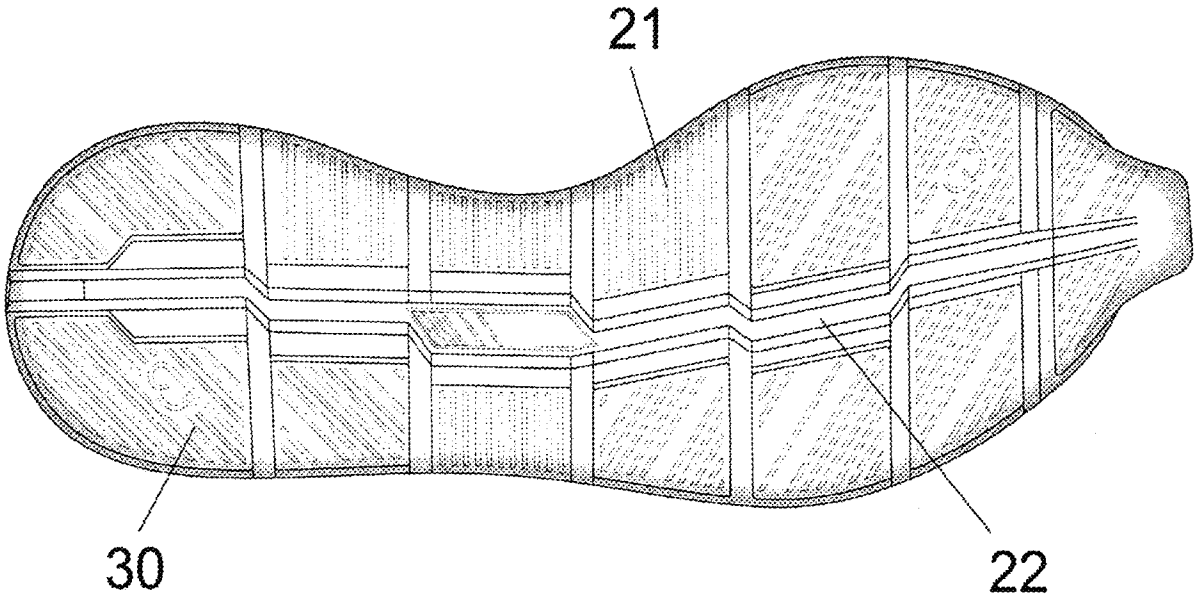
FIG. 2 shows the shoe from FIG. 1 from underneath.

As is evident in FIG. 2, which views the tread of the shoe from underneath, a longitudinal slot 22 extends in the midsole 20 from the heel region into the ball region over roughly the entire length of the shoe, dividing the midsole 20 into a medial part and a lateral part. The two parts are only connected to each other in the rear at the heel of the shoe and in the front at the toe of the shoe. The longitudinal slot 22 produces lateral-side and medial-side adjacent pairs of channel-shaped elements 21, which can be deformed independently of each other.

According to FIG. 2, the longitudinal slot 22 is intrinsically curved and is positioned so that the channel-shaped elements 21 in the heel region and mid-foot region are narrower on the medial side than they are on the lateral side and in the ball region, they are wider on the medial side than they are on the lateral side. Due to the shape and position of the longitudinal slot, it is particularly possible to influence and adjust the rolling characteristics of the sole structure.

The downward-opening recesses between the channel-shaped elements 21 and the longitudinal slot 22 preferably each widen out slightly toward the bottom, which for example prevents rocks from getting stuck in them and promotes self-cleaning of the sole structure.

To protect the sole structure from abrasion, the channel-shaped elements 21 in the heel and ball region that are subjected to the most stress are provided with thin-layered coverings made of a hard elastic material such as rubber; in FIG. 2, only one of these coverings, which are shown with a diagonal ribbing, is identified with the reference numeral 30. In the rest of the channel-shaped elements 21, the material of the midsole 20 is subject to direct contact with the ground.

The invention claimed is:

1. A sole structure for a flexible shoe with an elastic midsole (20), which at least partially comes into contact with a ground during walking, the sole structure comprising:

a plurality of channel-containing elements (21) with flat bottoms that are open at the side and oriented transversely in relation to a longitudinal direction of the midsole, and protrude downward toward the ground;

an edge strip (23) positioned along the midsole (20) which bridges the respective channel-containing elements (21), narrows a cross-section of channels in the channel-containing elements, and determines a height of lateral openings (24) of the channel-containing elements;

horizontal predetermined fold notches (25) provided on outward-facing ends of the channel-containing elements (21); and in response to forces acting in a vertical and/or longitudinal direction during walking, the channel-containing elements (21) deformable in the vertical and/or longitudinal direction until respective lateral openings (24) in a region of the edge strip (23) close, wherein the predetermined fold notches (25) include a vertical breadth, wherein the vertical breadth of the predetermined fold notches (25) is equal to the height of the lateral openings (24), and the predetermined fold notches (25) are respectively aligned with the lateral openings (24) of the channel-containing elements.

2. The sole structure according to claim 1, wherein the horizontal predetermined folding notches (25) include a depth that corresponds to 2.0-8.0 mm.

3. The sole structure according to claim 2 wherein the depth is one third of the vertical breadth.

4. The sole structure according to claim 1, further comprising a longitudinal slot (22) extending from a heel region into a ball region to divide the midsole (20) into a medial part and a lateral part.

5. The sole structure according to claim 1, wherein a thickness of the channel-containing elements (21) decreases from a heel region to a ball region, with the thickness of at least a rearmost channel-containing element (21) also being greater on a medial side than the thickness is on a lateral side.

6. The sole structure according to claim 1 wherein the vertical breadth of the predetermined fold notches (25) is aligned with the height of the lateral openings (24).

7. The sole structure according to claim 1 wherein the vertical breadth of the predetermined fold notches (25) is at a same length as the height of the lateral openings (24).

* * * * *